US009664200B2

(12) United States Patent
Oda et al.

(10) Patent No.: US 9,664,200 B2
(45) Date of Patent: May 30, 2017

(54) TURBO COMPRESSOR AND TURBO REFRIGERATOR

(71) Applicant: IHI Corporation, Tokyo (JP)

(72) Inventors: Kentarou Oda, Tokyo (JP); Seiichiro Yoshinaga, Tokyo (JP); Kazuaki Kurihara, Tokyo (JP); Nobuyoshi Sakuma, Tokyo (JP)

(73) Assignee: DAIKIN INDUSTRIES, LTD. (JP)

( * ) Notice: Subject to any disclaimer, the term of this patent is extended or adjusted under 35 U.S.C. 154(b) by 176 days.

(21) Appl. No.: 14/627,425

(22) Filed: Feb. 20, 2015

(65) Prior Publication Data

US 2015/0159668 A1 Jun. 11, 2015

Related U.S. Application Data

(63) Continuation of application No. PCT/JP2013/072843, filed on Aug. 27, 2013.

(30) Foreign Application Priority Data

Aug. 28, 2012 (JP) ..... 2012-187742

(51) Int. Cl.
*F04D 29/06* (2006.01)
*F25B 43/02* (2006.01)
(Continued)

(52) U.S. Cl.
CPC ..... *F04D 29/061* (2013.01); *F04D 17/10* (2013.01); *F04D 17/12* (2013.01); *F04D 25/02* (2013.01);
(Continued)

(58) Field of Classification Search
CPC ..... F04D 29/063; F04D 17/10; F04D 29/061; F04D 17/12; F04D 25/02; F04D 29/4213;
(Continued)

(56) References Cited

U.S. PATENT DOCUMENTS 3,286,480 A * 11/1966 Papapanu ..... F25B 1/08 62/188
3,392,804 A * 7/1968 La Fleur ..... F01D 25/18 184/6
(Continued)

FOREIGN PATENT DOCUMENTS

JP 55-066700 5/1980
JP 55-067367 5/1980
(Continued)

OTHER PUBLICATIONS

International Search Report and Written Opinion mailed Nov. 26, 2013 in corresponding PCT International Application No. PCT/JP2013/072843.

*Primary Examiner* — Mohammad M Ali
(74) *Attorney, Agent, or Firm* — Ostrolenk Faber LLP

(57) ABSTRACT

A turbo compressor that has a compression stage provided with an impeller that rotates; a housing provided with a gear unit accommodation space that accommodates lubricating oil and accommodates a large diameter gear that transmits rotating force to the impeller, an IGV accommodation space in which the ambient pressure is lower than the gear unit accommodation space, and a gap that brings the IGV accommodation space and the air intake side of a first compression stage into communication; a pressure equalizing tube that causes a gas to circulate from the gear unit accommodation space toward the IGV accommodation space; and a second oil separating device that separates, in the IGV accommodation space, the lubricating oil contained in the gas.

20 Claims, 3 Drawing Sheets

(51) Int. Cl.

| | |
|---|---|
| ***F04D 17/10*** | (2006.01) |
| ***F04D 29/063*** | (2006.01) |
| ***F04D 29/46*** | (2006.01) |
| ***F04D 17/12*** | (2006.01) |
| ***F04D 25/02*** | (2006.01) |
| ***F04D 29/42*** | (2006.01) |
| ***F25B 1/053*** | (2006.01) |
| *F25B 31/00* | (2006.01) |
| *F25B 1/10* | (2006.01) |
| *F25B 25/00* | (2006.01) |
| *F25B 31/02* | (2006.01) |

(52) U.S. Cl.
CPC ..... *F04D 29/063* (2013.01); *F04D 29/4213* (2013.01); *F04D 29/462* (2013.01); *F25B 1/053* (2013.01); *F25B 43/02* (2013.01); *F05D 2250/51* (2013.01); *F05D 2260/609* (2013.01); *F25B 1/10* (2013.01); *F25B 25/005* (2013.01); *F25B 31/004* (2013.01); *F25B 31/008* (2013.01); *F25B 31/026* (2013.01); *F25B 2339/047* (2013.01); *F25B 2341/0662* (2013.01); *F25B 2400/13* (2013.01); *F25B 2400/23* (2013.01)

(58) Field of Classification Search
CPC .... F04D 29/462; F04D 2250/51; F25B 43/02; F25B 1/053; F25B 2400/13; F25B 25/005; F25B 31/008; F25B 2400/23; F25B 31/004; F25B 2339/047; F05D 2260/609; F05D 2250/51
USPC ..... 62/470, 468; 415/112
See application file for complete search history.

(56) References Cited

U.S. PATENT DOCUMENTS

| | | | | |
|---|---|---|---|---|
| 4,213,307 | A | 7/1980 | Watson | 62/192 |
| 4,938,664 | A | 7/1990 | Zinsmeyer | 417/83 |
| 6,018,962 | A | 2/2000 | Dewhirst | 62/468 |
| 6,672,088 | B2 * | 1/2004 | Ueda | F16K 3/262 251/31 |
| 6,675,594 | B2 * | 1/2004 | Choi | F25B 1/053 62/197 |
| 2003/0110786 | A1 * | 6/2003 | Ueda | F16K 3/262 62/197 |
| 2006/0150668 | A1 * | 7/2006 | Ro | F04D 29/05 62/510 |
| 2006/0248897 | A1 * | 11/2006 | Haertel | F02C 7/143 60/775 |
| 2007/0147985 | A1 * | 6/2007 | Takahashi | F04D 17/12 415/104 |
| 2009/0193841 | A1 * | 8/2009 | Sugitani | F04D 17/122 62/498 |
| 2010/0031683 | A1 * | 2/2010 | Ueda | F25B 49/025 62/230 |
| 2010/0170274 | A1 * | 7/2010 | Ueda | F04D 27/0261 62/238.6 |
| 2010/0326130 | A1 * | 12/2010 | Takada | F25B 1/10 62/510 |
| 2011/0016914 | A1 * | 1/2011 | Oda | F04D 17/12 62/468 |
| 2011/0016916 | A1 * | 1/2011 | Tsukamoto | F04D 29/063 62/498 |
| 2011/0120162 | A1 * | 5/2011 | Ueda | F25B 1/053 62/228.1 |
| 2011/0167843 | A1 * | 7/2011 | Ueda | F25B 30/02 62/79 |
| 2011/0239695 | A1 * | 10/2011 | Sugitani | F04D 25/04 62/498 |
| 2011/0243710 | A1 * | 10/2011 | Kurihara | F04D 25/04 415/110 |
| 2012/0053898 | A1 * | 3/2012 | Togano | F25B 1/053 702/182 |
| 2012/0174609 | A1 * | 7/2012 | Matsuo | F24F 11/006 62/190 |

FOREIGN PATENT DOCUMENTS

| | | |
|---|---|---|
| JP | 03-172599 | 7/1991 |
| JP | 2009-185710 | 8/2009 |
| JP | 2011-026960 | 2/2011 |

* cited by examiner

TURBO COMPRESSOR AND TURBO REFRIGERATOR

This application is a Continuation of International Application No. PCT/JP2013/072843, filed on Aug. 27, 2013, claiming priority based on Japanese Patent Application No. 2012-187742, filed on Aug. 28, 2012, the contents of both International Application and the Japanese Application are incorporated herein by reference in their entity.

TECHNICAL FIELD

The present invention relates to a turbo compressor and a turbo refrigerator.

BACKGROUND ART

As a turbo compressor that is applied to a turbo refrigerator and the like, there is known in the prior art one that is provided with a housing in which lubricating oil is housed, a large diameter gear as a gear member that is housed in this housing and by whose rotation lubricating oil is supplied, and a demister that is arranged above the large diameter gear in the housing, is provided with an intake port that is in communication with the outside of the housing, and which catches the lubricating oil kicked up by the rotation of the large diameter gear and returns it to the lower part of the housing (for example, refer to Patent Document 1).

In this kind of turbo compressor, the intake port of the demister is connected to a space with a lower pressure than the interior of the housing via a pressure equalizing tube, whereby an increase in pressure in the housing is inhibited. Also, in the housing, oil smoke is produced by the lubricating oil that is kicked up by the rotation of the gear member. For this reason, the demister, when suctioning in air in the housing from the intake port, prevents the lubricating oil from being discharged to the outside of the housing by catching the lubricating oil that is mixed in the air and returning it to the lower part of the housing.

PRIOR ART DOCUMENTS

Patent Documents

[Patent Document 1] Japanese Unexamined Patent Application, First Publication No. 2011-26960

DISCLOSURE OF THE INVENTION

Problems to be Solved by the Invention

However, in the turbo compressor as described above, there is a large quantity of lubricating oil that reaches the demister, and since the lubricating oil cannot be completely caught by the demister, there is a possibility of the lubricating oil being discharged to the outside of the housing.

When the lubricating oil is discharged to the outside of the housing, a phenomenon occurs in which the oil gradually disappears (oil loss) and collects for example in the condenser and evaporator and the like connected to the turbo compressor, which leads to a drop in the performance of these heat exchange devices.

The present invention is achieved in view of the above circumstances, and has as its object to provide a turbo compressor and a turbo refrigerator that can effectively inhibit discharge of the lubricating oil.

Means for Solving the Problems

The first aspect of the present invention is a turbo compressor having a compression stage provided with an impeller that rotates; a housing provided with a first space that accommodates lubricating oil and accommodates a gear member that transmits rotating force to the impeller, a second space in which the ambient pressure is lower than the first space, and a gap that brings the second space and the air intake side of the compression stage into communication; a pressure equalizing tube that causes a gas to circulate from the first space toward the second space; and an oil separating device that separates, in the second space, the lubricating oil contained in the gas.

In the first aspect of the present invention, by providing the oil separating device in the second space, prior to the gas that flows in via the pressure equalizing tube from the first space, which accommodates the lubricating oil, leaking out from the gap of the housing to the air intake side of the compression stage, it is possible to separate the lubricating oil that is contained in that gas. For that reason, the lubricating oil is not discharged to outside of the housing.

In the second aspect of the present invention, the oil separating device of the first aspect has a cover member that is provided surrounding the gap and in which a suction port for the gas is formed, and a demister that catches the lubricating oil contained in the gas that is suctioned in from the suction port.

In the second aspect of the present invention, the gap of the housing is surrounded by the cover member so that the gas that flows in via the pressure equalizing tube does not directly leak out from the gap, and the demister is provided in the suction port of the cover member so as to be able to cause the gas to leak out from the gap after the lubricating oil is removed therefrom by passing through the demister.

In the third aspect of the present invention, the second space in the second aspect has a ring shape, and the suction port is arranged in the second space on the opposite side with respect to a communicating opening of the pressure equalizing tube, sandwiching the center of the ring shape.

In the third aspect of the present invention, since the suction port of the cover member is on the opposite side with respect to a communicating opening of the pressure equalizing tube, it is possible to elongate the circulation passage of the gas that flows in via the pressure equalizing tube until reaching the suction port. In this way, by making the circulation passage of gas in the second space as circuitous as possible, it is possible to enable the removal of lubricating oil that is contained in the gas even in this circulation process.

In the fourth aspect of the present invention, the suction port in the second or third aspect is arranged oppositely oriented with respect to the communicating opening of the pressure equalizing tube in the second space.

In the fourth aspect of the present invention, since the suction port of the cover member is oppositely oriented with respect to the communicating opening of the pressure equalizing tube, the flow direction of the gas that flows in via the pressure equalizing tube sharply bends to become the opposite direction upon reaching the suction port. In this way, by sharply bending the flow direction of the gas that flows in in the second space, it is possible to enable the removal of lubricating oil contained in the gas even when reaching the suction port.

In the fifth aspect of the present invention, the suction port of any of the second to fourth aspects is arranged facing downward in the second space.

In the fifth aspect of the present invention, the lubricating oil that is caught by the demister can drip by its own weight to outside of the cover member from the suction port facing downward. For this reason, it is possible to prevent the caught lubricating oil from collecting in the cover member.

In the sixth aspect of the present invention, any of the first to fifth aspects has an oil returning device that returns to the first space the lubricating oil separated in the second space.

In the sixth aspect of the present invention, by returning to the first space the lubricating oil separated from the gas in the second space, it is possible to prevent a drop in the liquid level of the lubricating oil in the first space.

In the seventh aspect of the present invention, the oil returning device of the sixth aspect has an ejector.

In the seventh aspect of the present invention, it is possible to return to the first space the lubricating oil separated from the gas in the second space by the ejector.

The eighth aspect of the present invention is a turbo refrigerator that has a condenser that liquefies a compressed refrigerant; an evaporator that by evaporating the refrigerant that is liquefied by the condenser cools a cooling object; and a turbo compressor that compresses the refrigerant that is evaporated by the evaporator and supplies it to the condenser, in which it has the turbo compressor according to any one of the first to seventh aspects as the turbo compressor.

Effects of the Invention

According to the present invention, a turbo compressor and a turbo refrigerator capable of effectively inhibiting the discharge of lubricating oil are obtained.

EMBODIMENTS FOR CARRYING OUT THE INVENTION

Figure 1:
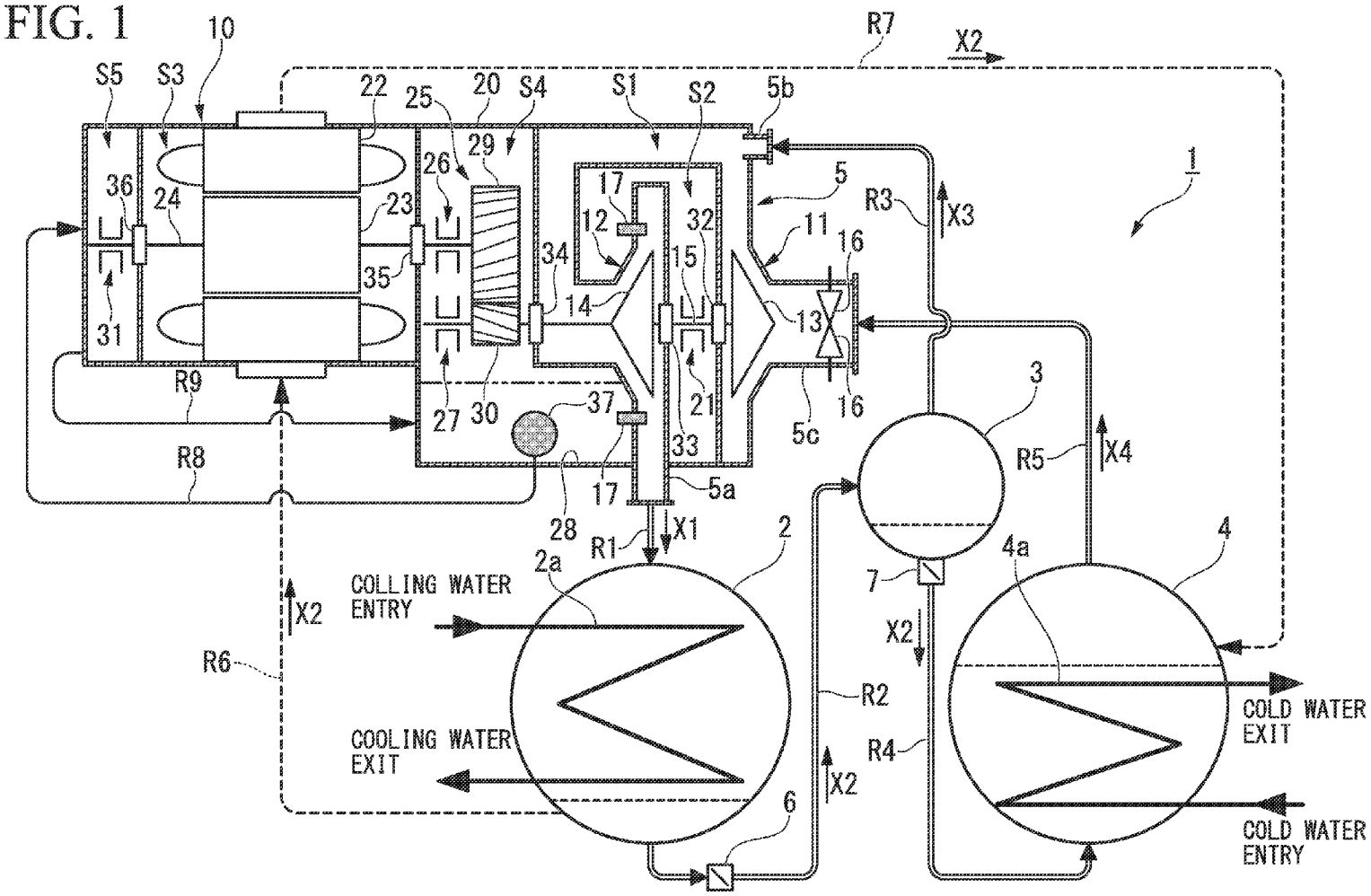
FIG. 1 is a system diagram of the turbo refrigerator in the embodiment of the present invention.

Hereinbelow, an embodiment of the present invention shall be described referring to the drawings.

FIG. 1 is a system diagram of a turbo refrigerator 1 in the embodiment of the present invention.

The turbo refrigerator 1 of the present embodiment has cold water for air conditioning as the object to be cooled, with for example Freon serving as the refrigerant. As shown in FIG. 1, the turbo refrigerator 1 is provided with a condenser 2, an economizer 3, an evaporator 4, and a turbo compressor 5.

The condenser 2 is connected with a gas discharge tube 5*a* of the turbo compressor 5 via a flow passage R1. The refrigerant that is compressed by the turbo compressor 5 (the compressed refrigerant gas X1) is supplied to the condenser 2 through the flow passage R1. The condenser 2 liquefies this compressed refrigerant gas X1. The condenser 2 is provided with a heat transfer tube 2*a* through which cooling water circulates, and cools the compressed refrigerant gas X1 by heat exchange between the compressed refrigerant gas X1 and the cooling water.

The compressed refrigerant gas X1 is cooled by the heat exchange with the cooling water, liquefies to become a refrigerant liquid X2, and collects at the bottom of the condenser 2. The bottom of the condenser 2 is connected with an economizer 3 via a flow passage R2. An expansion valve 6 that decompresses the refrigerant liquid X2 is provided in the flow passage R2. The refrigerant liquid X2 that is decompressed by the expansion valve 6 is supplied to the economizer 3 through the flow passage R2. The economizer 3 stores the decompressed refrigerant liquid X2 temporarily, and separates the refrigerant into a liquid phase and a gas phase.

The top portion of the economizer 3 is connected with an economizer connecting tube 5*b* of the turbo compressor 5 via a flow passage R3. The gas phase component X3 of the refrigerant separated by the economizer 3 is supplied through the flow passage R3 to a second compression stage 12 in the turbo compressor 5 without passing through the evaporator 4 and a first compression stage 11, and enhances efficiency. On the other hand, the bottom portion of the economizer 3 is connected with the evaporator 4 via a flow passage R4. An expansion valve 7 for further decompressing the refrigerant liquid X2 is provided in the flow passage R4.

The refrigerant liquid X2 that is decompressed further by the expansion valve 7 is supplied to the evaporator 4 through the flow passage R4. By evaporating the refrigerant liquid X2, the evaporator 4 cools cold water with the evaporation heat. The evaporator 4 is provided with a heat-transfer tube 4*a* through which the cold water circulates, and cools the cold water and evaporates the refrigerant liquid X2 by the heat exchange between the refrigerant liquid X2 and the cold water. By the heat exchange with the cold water, the refrigerant liquid X2 draws heat, evaporates, and becomes refrigerant gas X4.

The top portion of the evaporator 4 is connected with a gas suction tube 5*c* of the turbo compressor 5 via a flow passage R5. The refrigerant gas X4 which is evaporated in the evaporator 4 is supplied to the turbo compressor 5 through the flow passage R5. The turbo compressor 5 compresses the refrigerant gas X4 which is evaporated, and supplies it to the condenser 2 as compressed refrigerant gas X1. The turbo compressor 5 is a two-stage compressor that is provided with the first compression stage 11 that compresses the refrigerant gas X4, and the second compression stage 12 that further compresses the refrigerant that is subjected to one stage of compression.

An impeller 13 is provided in the first compression stage 11, an impeller 14 is provided in the second compression stage 12, and they are connected by a rotation shaft 15. The turbo compressor 5 compresses the refrigerant by rotating the impellers 13 and 14 with an electric motor 10. The impellers 13 and 14 are radial impellers and have blades with three-dimensional torsion, not illustrated, that discharge in the radial direction refrigerant taken in in the axial direction.

An inlet guide vane 16 that adjusts the suction quantity of the first compression stage 11 is provided in the gas suction tube 5*c*. The inlet guide vane 16 is made rotatable so that the apparent area from the flow direction of the refrigerant gas X4 can be changed. A diffuser flow passage is provided around each of the impellers 13 and 14, and the refrigerant that is ejected in the radial direction is compressed and raised in pressure in these flow passages. Moreover, it is possible to supply the refrigerant to the next compression stage by a scroll flow passage that is provided around the impellers 13 and 14. An outlet throttle valve 17 is provided around the impeller 14, whereby the outlet throttle valve 17 can control the discharge amount from the gas discharge tube 5*a*.

The turbo compressor 5 is equipped with an enclosed-type housing 20. The housing 20 is divided into a compression flow passage space S1, a first bearing accommodation space S2, a motor accommodation space S3, a gear unit accommodation space (first space) S4, a second bearing accommodation space S5, and an inlet guide vane driving mechanism accommodation space (second space) S6 (hereinbelow called IGV accommodation space S6. It is not illustrated in FIG. 1, so refer to FIG. 2 described below). The impellers 13 and 14 are provided in the compression flow passage space S1. The rotation shaft 15 which connects the impellers 13 and 14 is provided inserted in the compression flow passage space S1, the first bearing accommodation space S2, and the gear unit accommodation space S4. A bearing 21 that supports the rotation shaft 15 is provided in the first bearing accommodation space S2.

A stator 22, a rotor 23, and a rotation shaft 24 connected to the rotor 23 are provided in the motor accommodation space S3. This rotation shaft 24 is provided inserted in the motor accommodation space S3, the gear unit accommodation space S4, and the second bearing accommodation space S5. A bearing 31 that supports the anti-load side of the rotation shaft 24 is provided in the second bearing accommodation space S5. A gear unit 25, bearings 26 and 27, and an oil tank 28 are provided in the gear unit accommodation space S4.

A gear unit 25 has a large diameter gear (gear member) 29 fixed to the rotation shaft 24, and a small diameter gear 30 that is fixed to the rotation shaft 15 and meshes with the large diameter gear 29. The gear unit 25 transmits rotating force so that the rotation frequency of the rotation shaft 15 may increase (become faster) with respect to the rotation frequency of the rotation shaft 24. The bearing 26 supports the rotation shaft 24. The bearing 27 supports the rotation shaft 15. The oil tank 28 stores the lubricating oil supplied to each sliding portion of the bearings 21, 26, 27, 31 and the like.

In this kind of housing 20, seal portions 32 and 33 that seal the periphery of the rotation shaft 15 are provided between the compression flow passage space S1 and the first bearing accommodation space S2. Moreover, in the housing 20, a seal portion 34 that seals the periphery of the rotation shaft 15 is provided between the compression flow passage space S1 and the gear unit accommodation space S4. Also, in the housing 20, a seal portion 35 that seals the periphery of the rotation shaft 24 is provided between the gear unit accommodation space S4 and the motor accommodation space S3. Also, in the housing 20, a seal portion 36 that seals the periphery of the rotation shaft 24 is provided between the motor accommodation space S3 and the second bearing accommodation space S5.

The motor accommodation space S3 is connected with the condenser 2 via a flow passage R6. The refrigerant liquid X2 is supplied from the condenser 2 through the flow passage R6 to the motor accommodation space S3. The refrigerant liquid X2 that is supplied to the motor accommodation space S3 circulates around the stator 22, and by heat exchange with the stator 22 and its surroundings, cools the motor accommodation space S3. The motor accommodation space S3 is connected with the evaporator 4 via the flow passage R7. The refrigerant liquid X2 that draws the heat in the motor accommodation space S3 is supplied to the evaporator 4 via a flow passage R7.

The oil tank 28 has a siphon pump 37. The siphon pump 37 is connected with the second bearing accommodation space S5 via for example a flow passage R8. Lubricating oil is supplied from the oil tank 28 to the second bearing accommodation space S5 through the flow passage R8. The lubricating oil supplied to the second bearing accommodation space S5 is supplied to the bearing 31, and secures the lubricity of the sliding portions of the rotating shaft 24 as well as inhibits the generation of heat of the sliding portions (performs cooling). The second bearing accommodation space S5 is connected with the oil tank 28 via a flow passage R9. The lubricating oil supplied to the second bearing accommodation space S5 returns to the oil tank 28 through the flow passage R9.

Here, some of the refrigerant liquid X2 supplied to the motor accommodation space S3 evaporates, whereby the ambient pressure of the motor accommodation space S3 becomes high, and when it leaks out from for example the seal portion 35 to the gear unit accommodation space S4, the ambient pressure of the gear unit accommodation space S4 becomes high. In the gear unit accommodation space S4 is provided with the oil tank 28 to which the lubricating oil returns from each sliding portion via the flow passage R9 and the like. For that reason, when the ambient pressure of the gear unit accommodation space S4 becomes high in this way, there results a reduction in the lubricating oil that returns to the oil tank 28.

Figure 2:
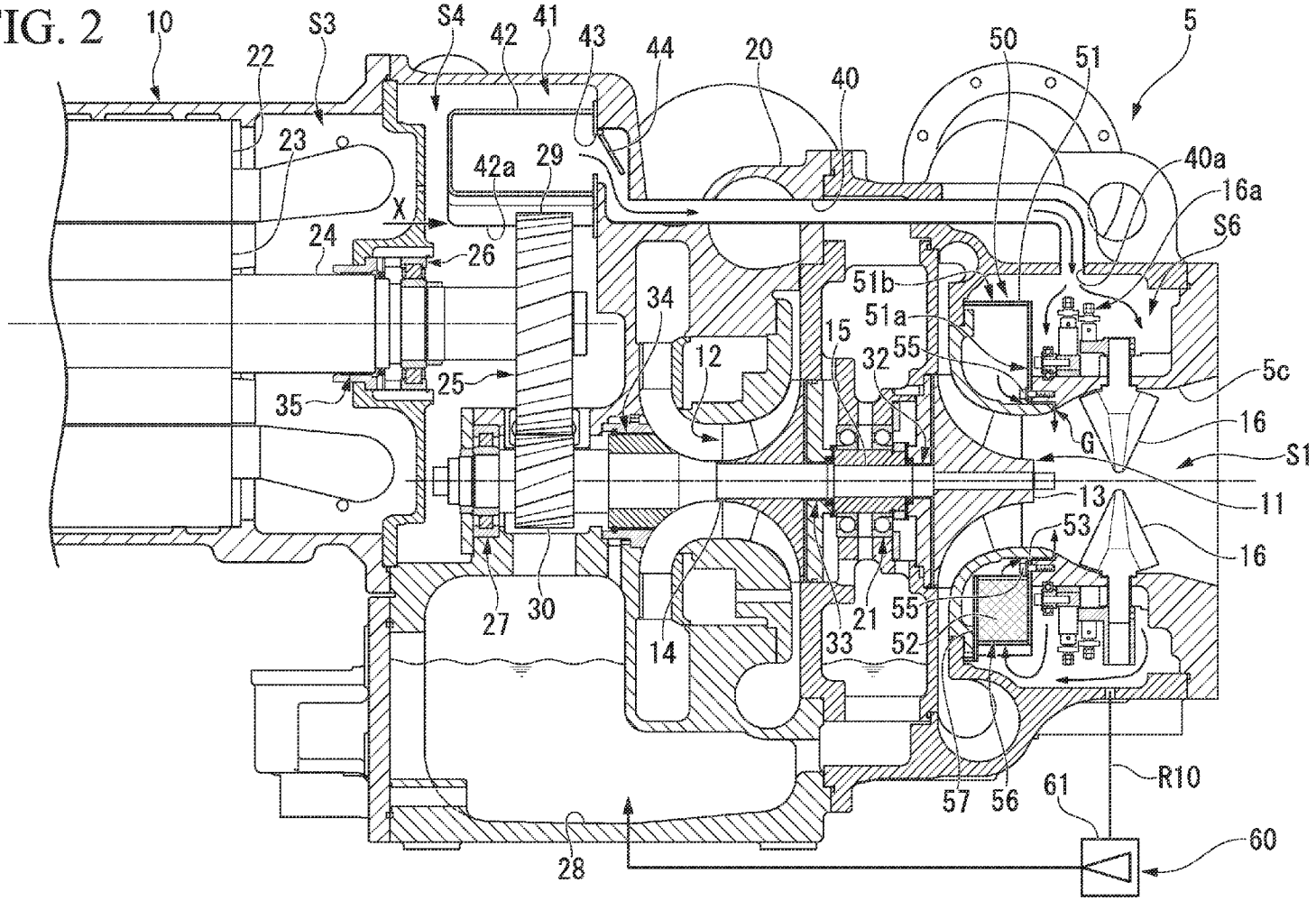
FIG. 2 is a cross-sectional view of a turbo compressor in the embodiment of the present invention.

For this reason, the turbo compressor 5 is equipped with the constitution shown in FIG. 2.

FIG. 2 is a cross-sectional view of the turbo compressor 5 in the first embodiment of the present invention.

The turbo compressor 5 has a pressure equalizing tube 40 that brings the gear unit accommodation space S4 and the IGV accommodation space S6 into communication as shown in FIG. 2. A drive mechanism 16*a* of the inlet guide vane 16 is provided in the IGV accommodation space S6. The IGV accommodation space S6 is provided in an annular shape around the first compression stage 11 and the gas suction tube 5*c*. The IGV accommodation space S6 communicates with the compression flow passage space S1 at the gas suction tube 5*c* of the upstream side of the first compression stage 11 via a gap G formed in the housing 20.

The compression flow passage space S1 which is communicated by the gap G enters a negative pressure state when the impeller 13 rotates at the intake side of the first compression stage 11, and the ambient pressure becomes the lowest in the enclosed-type housing 20. The ambient pressure becomes low because the IGV accommodation space S6 is communicated with the compression flow passage space S1 via the gap G. The pressure equalizing tube 40, by connecting the space between this IGV accommodation space S6 and the gear unit accommodation space S4, circulates the gas of the gear unit accommodation space S4 from the gear unit accommodation space S4 toward the IGV accommodation space S6, and reduces the ambient pressure of the gear unit accommodation space S4.

The lubricating oil is kicked up, and oil droplets and oil smoke are generated, by the large diameter gear 29 that transmits rotating force particularly to the impellers 13 and 14 of the gear unit 25 in the gear unit accommodation space S4. A first oil separating device 41 that separates the lubricating oil contained in this gas is provided in the gear unit accommodation space S4. The first oil separating device 41 is arranged above the large-diameter gear 29, and is fixed by a fixing member such as a bolt to the housing 20. The first oil separating device 41 has a suction duct 42. The suction duct 42 has an interconnecting opening 43 that communicates with the pressure equalizing tube 40. A check valve 44 is provided in the interconnecting opening 43.

The check valve 44 prevents back flow of the gas of the IGV accommodation space S6 which heads from the IGV accommodation space S6 to the gear unit accommodation space S4. When shutting down the turbo compressor 5, the refrigerant flows backwards from the condenser 2 to the turbo compressor 5, and so the ambient pressure of the compression flow passage space S1 and the IGV accommodation space S6 may become higher than the gear unit accommodation space S4. In this case, the check valve 44 can prevent the back flow of this gas. A demister not illustrated is provided in this suction duct 42, and it catches lubricating oil contained in the suctioned gas and returns the lubricating oil that is caught from a suction opening 42*a* to the oil tank 28 below.

The lubricating oil that is kicked up by the rotation of the large-diameter gear 29 is caught by this kind of first oil separating device 41, and so the discharge of the lubricating oil to the outside of the gear unit accommodation space S4 is prevented. However, when there is a large amount of the lubricating oil mixed into the gas in the gear unit accommodation space S4, the lubricating oil sometimes may not be sufficiently caught by the first oil separating device 41. The lubricating oil, when discharged to the IGV accommodation space S6 by being carried by the air flow in the pressure equalizing tube 40, is introduced from the IGV accommodation space S6 to the compression flow passage space S1, and collects in the condenser 2 or the evaporator 4, whereby oil loss occurs. Therefore, a second oil separating device 42 (oil separating device) that separates the lubricating oil contained in the gas is provided in the IGV accommodation space S6.

Figure 3A:
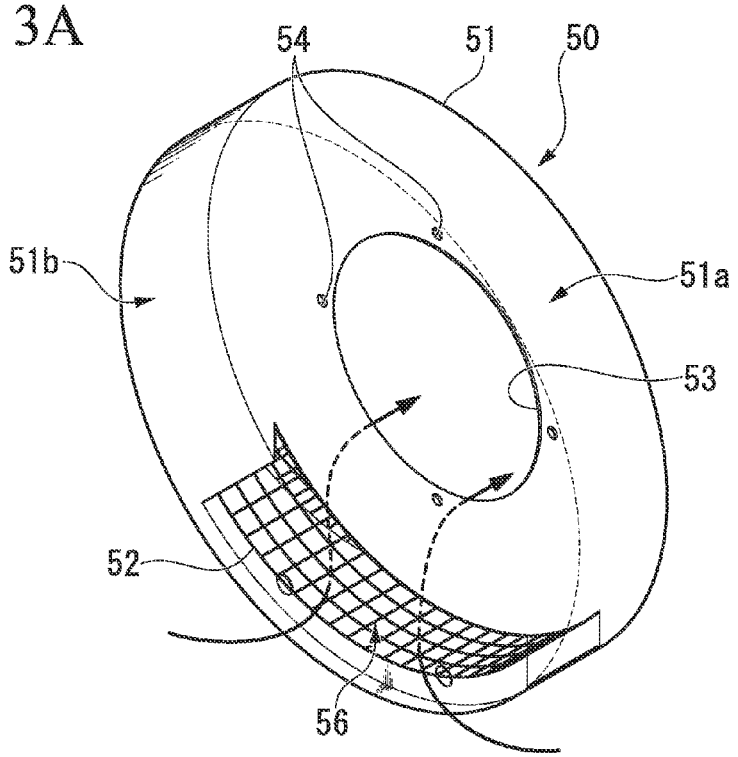
FIG. 3A is a perspective view of the front side showing the constitution of the second oil separating device in the embodiment of the present invention.
Figure 3B:
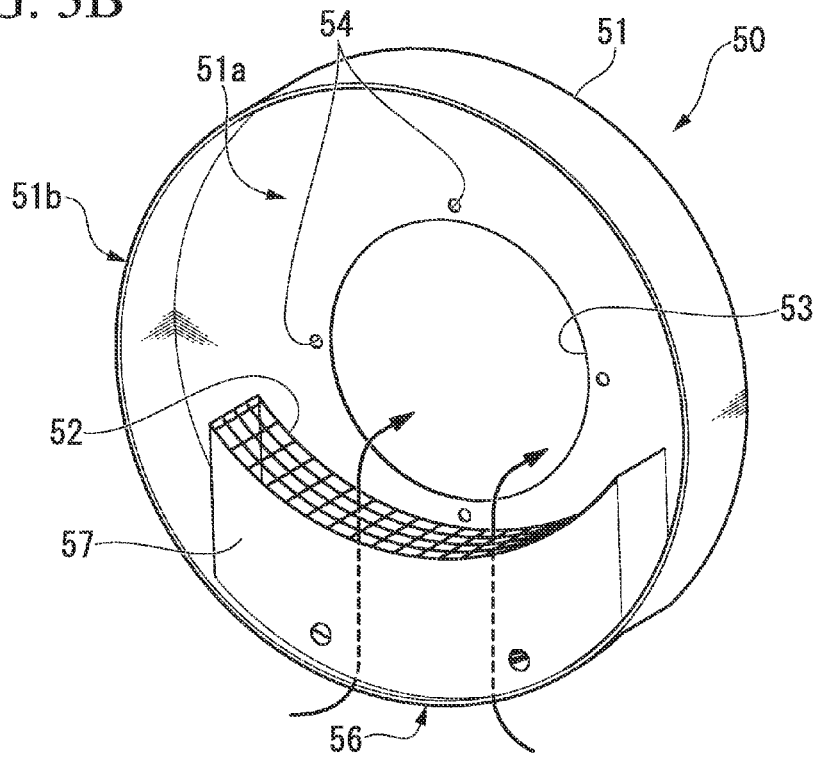
FIG. 3B is a perspective view of the back side showing the constitution of the second oil separating device in the embodiment of the present invention.

FIG. 3A and FIG. 3B are perspective views of the front side and rear side showing the constitution of the second oil separating device 50 in the embodiment of the present invention.

The second oil separating device 50 separates the lubricating oil contained in the gas in the IGV accommodation space S6. The second oil separating device 50 has a cover member 51 and a demister 52. As shown in FIG. 2, the cover member 51, by surrounding the gap G that brings the IGV accommodation space S6 and the compression flow passage space S1 into communication, prevents the gas that flows in via the pressure equalizing tube 40 from directly leaking out from the gap G.

As shown in FIG. 3B, the cover member 51 has a disc-like bottom portion 51*a* and a cylindrical trunk portion 51*b*. The bottom portion 51*a* has an opening 53 that is formed in the center. The opening 53 communicates with the gap G, and is an outflow port for gas that is suctioned. The bottom portion 51*a* has a mounting hole 54. The mounting holes 54 are provided in a plurality (four in the present embodiment) around the opening 53. A bolt 55 (refer to FIG. 2) is inserted in each mounting hole 54 as a fixing member. As shown in FIG. 2, the bolt 55, by pressing and fixing the bottom portion 51*a* of the cover member 51 against the housing 20, seals the circumference of the opening 53.

As shown in FIG. 3B, the trunk portion 51*b* is integrally joined along the outer edge of the bottom portion 51*a*. Due to the joining of the trunk portion 51*b*, the cover member 51 has a bucket shape. This kind of cover member 51, as shown in FIG. 2, is arranged so as to cover the periphery of the first compression stage 11. A portion of the distal end of the first compression stage 11 is arranged so as to be inserted in the opening 53, and the inner side of the cover member 51 communicates with the gap G. Also, the opening end of the trunk portion 51*b* on the opposite side of the bottom portion 51*a* abuts the housing 20 in the axial direction, whereby it is blocked by the housing 20.

As shown in FIG. 3A, the cover member 51 has a gas suction port 56. The suction port 56 brings the outer side and inner side of the cover member 51 into communication. The suction port 56 is formed by cutting out a portion of the bottom portion 51*a* and the trunk portion 51*b*, and opens in the radial direction.

The demister 52 is provided in the inner side of the cover member 51. The demister 52 is a packing that consists of a catching member with a lattice shape or mesh shape, and is filled in the suction port 56. As shown in FIG. 3B, the demister 52 is attached to an attachment plate 57, and is provided at a region of a predetermined height facing upward from the suction port 56.

As shown in FIG. 2, the suction port 56 of the cover member 51 is arranged in the ring-shaped IGV accommodation space S6 on the opposite side with respect to a communicating opening 40*a* of the pressure equalizing tube 40, sandwiching the center of the ring shape. That is, the communicating opening 40*a* of the pressure equalizing tube 40 opens to the ring top portion of the IGV accommodation space S6, while the suction port 56 of the cover member 51 opens to the ring bottom portion of the IGV accommodation space S6. In the present embodiment, the suction port of the cover member 51 is arranged at a position separated the most from the communicating opening 40*a* of the pressure equalizing tube 40 in order for the gas that flows in via the pressure equalizing tube 40 to take the longest way around in the distribution process to the suction port 56.

Also, the suction port 56 of the cover member 51 is arranged oppositely oriented with respect to the communicating opening 40*a* of the pressure equalizing tube 40 in the IGV accommodation space S6. That is, while the communicating opening 40*a* of the pressure equalizing tube 40 opens downward at the ring top portion of the IGV accommodation space S6, the suction port 56 of the cover member 51 opens downward at the ring bottom portion of the IGV accommodation space S6. In this kind of embodiment, the communicating opening 40*a* of the pressure equalizing tube 40 and the suction port 56 of the cover member 51 are arranged so as not to face each other in order to sharply bend the flow direction of the gas, which flows in via the pressure equalizing tube 40, just before entering the suction port 56.

The present embodiment has an oil returning device 60 that returns to the gear unit accommodation space S4 the lubricating oil separated in the IGV accommodation space S6. The oil returning device 60 has a flow passage R10 and an ejector 61. The flow passage R10 connects the bottom of the IGV accommodation space S6 and the oil tank 28. The ejector 61 that transports the lubricating oil is provided in the flow passage R10. The ejector 61 generates negative pressure by the movement of a fluid, and thereby suctions and conveys the lubricating oil that is collected at the bottom of the IGV accommodation space S6. It is possible to use the lubricating oil that returns from each sliding portion back to the oil tank 28 or the compressed refrigerant gas X1 as the fluid.

Next, the action of the second oil separating device 50 with the aforementioned constitution shall be described.

As shown in FIG. 2, the lubricating oil is kicked up, and oil droplets and oil smoke are generated, by the large diameter gear 29 that transmits rotating force particularly to the impellers 13 and 14 of the gear unit 25 in the gear unit accommodation space S4. Although the first oil separating device 41 that separates the lubricating oil that has become oil droplets and oil smoke from the gas portion is provided in the gear unit accommodation space S4, when there is a large quantity of the lubricating oil mixed with the gas, the lubricating oil that could not be caught by the first oil separating device 41 is discharged to the IGV accommodation space S6 by being carried by the air flow in the pressure equalizing tube 40.

The second oil separating device 50 that separates the lubricating oil contained in this gas is provided in the IGV accommodation space S6. Prior to the gas that flows in from the gear unit accommodation space S4 via the pressure equalizing tube 40 leaking out from the gap G of the housing 20 to the air intake side of the first compression stage 11, the second oil separating device 50 separates the lubricating oil contained in that gas. The second oil separating device 50 surrounds the gap G of the housing 20 by the cover member 51 to ensure that the gas that flows in via the pressure equalizing tube 40 does not leak out directly from the gap G, and provides the demister 52 in the gas suction port 56 of the cover member 51 to cause the gas to leak out from the gap G after the lubricating oil is removed by passing through the demister 52.

In the ring-shaped IGV accommodation space S6, the gas suction port 56 of the cover member 51 is arranged on the opposite side with respect to the communicating opening 40*a* of the pressure equalizing tube 40, sandwiching the center of the ring shape. When the gas suction port 56 of the cover member 51 is on the opposite side with respect to the communicating opening 40*a* of the pressure equalizing tube 40, it is possible to ensure the length of the circulation passage of the gas that flows in via the pressure equalizing tube 40 until reaching the gas suction port 56. Then, in the process of the gas that flows in from the communicating opening 40*a* circulating along the ring shape through the IGV accommodation space S6, at least a portion of the lubricating oil that is contained in this gas condenses by coming into contact with the housing 20 and peripheral members, and is removed by the centrifugal force arising from the curve. In this way, by making the circulation passage of gas in the IGV accommodation space S6 as circuitous as possible, it is possible to remove lubricating oil that is contained in the gas even in this circulation process.

Also, the suction port 56 of the cover member 51 is arranged oppositely oriented with respect to the communicating opening 40*a* of the pressure equalizing tube 40, in the IGV accommodation space S6. When the suction port 56 of the cover member 51 is arranged oppositely oriented with respect to the communicating opening 40*a* of the pressure equalizing tube 40, the gas that flows in via the pressure equalizing tube 40, upon reaching the suction port 56, has its flow direction sharply bent to become the opposite direction. By sharply bending the flow direction of the gas that flows into the IGV accommodation space S6, at least a portion of the lubricating oil that is contained in the gas is flicked to the outside and separated from the flow of gas by the inertia of the lubricating oil, which cannot withstand the sudden change in direction. In this way, by arranging the communicating opening 40*a* of the pressure equalizing tube 40 and the suction port 56 of the cover member 51 so as not to face each other, it is possible to remove the lubricating oil that is contained in the gas even upon reaching the suction port 56.

The gas that is suctioned from the suction port 56 passes through the demister 52. The demister 52 is constituted by a lattice-shaped member or mesh-shaped member, so that when the gas passes, it is able to catch the lubricating oil that is contained in the gas. For this reason, it is possible to prevent discharge of the lubricating oil from the gap G to the outside of the housing 20, through the compression circulation space S1. The lubricating oil that is caught in the demister 52 drips by its own weight from the suction port 56, which opens facing downward of the IGV accommodation space S6, and collects at the bottom of the IGV accommodation space S6. In this way, by arranging the suction port 56 to face downward in the IGV accommodation space S6, it is possible to prevent lubricating oil that is caught from collecting on the inner side of the cover member 51.

Also, in the present embodiment, the oil returning device 60 is provided, and the flow passage R10 that extracts lubricating oil that is collected is connected to the bottom of the IGV accommodation space S6. The lubricating oil that is separated in the IGV accommodation space S6 is sent to the gear unit accommodation space S4 via the flow passage R10 by the ejector 61. In this way, since the separated lubricating oil returns to the oil tank 28 of the gear unit accommodation space S4 without collecting in the IGV accommodation space S6, it is possible to reliably prevent oil loss.

That is to say, the embodiment given above adopts the turbo compressor 5 having the compression stages 11 and 12 that are provided with the impellers 13 and 14 that rotate, a housing 20 provided with the gear unit accommodation space S4 that accommodates the lubricating oil and accommodates the large diameter gear 29 which transmits rotating force to the impellers 13 and 14, the IGV accommodation space S6 in which the ambient pressure is lower than the gear unit accommodation space S4, and the gap G that brings the IGV accommodation space S6 and the air intake side of the first compression stage 11 into communication, the pressure equalizing tube 40 that causes a gas to circulate from the gear unit accommodation space S4 toward the IGV accommodation space S6, and the second oil separating device 50 that separates, in the IGV accommodation space S6, the lubricating oil contained in the gas. As a result, according to this turbo compressor, it is possible to effectively inhibit discharge of the lubricating oil, and it is possible to inhibit the occurrence of oil loss, and a reduction in the heat exchanging performance of the condenser 2 and the evaporator 4.

Hereinabove, the preferred embodiment of the present invention is described while referring to the drawings, but the present invention is not limited to the aforementioned embodiment. The various shapes and combinations of each composite member shown in the embodiment described above refer to only a single example, and various modifications are possible based on design requirements and so forth within a scope that does not deviate from the subject matter of the present invention.

For example, in the embodiment, a description is given for a mode in which the oil returning device is provided with an ejector, but the present invention is not limited to this constitution, and a mode is also possible in which for example the oil returning device is provided with an electric pump.

Also, for example, in the embodiment, a description is given for a mode that is provided with a cover member and a demister in order to ensure that gas does not directly leak out from the gap while elongating the gas circulation passage of the gas in the second space, but the present invention is not limited to this constitution, and for example it may be a mode in which the demister is arranged directly at the communicating opening of the pressure equalizing tube to separate lubricating oil.

INDUSTRIAL APPLICABILITY

According to the turbo compressor and the turbo refrigerator of the present invention, it is possible to effectively inhibit discharge of lubricating oil.

DESCRIPTION OF THE REFERENCE SYMBOLS

1: Turbo refrigerator
2: Condenser
4: Evaporator
5: Turbo compressor
11: First compression stage (compression stage)
12: Second compression stage (compression stage)
13: Impeller
14: Impeller
20: Housing
29: Large-diameter gear (gear member)
40: Pressure equalizing tube
40*a*: Communicating opening
50: Second oil separating device (oil separating device)
51: Cover member
52: Demister
56: Suction port
60: Oil returning device
61: Ejector
G: Gap
S4: Gear unit accommodation space (first space)
S6: IGV accommodation space (second space)

The invention claimed is:

1. A turbo compressor comprising:
a compression stage provided with an impeller that rotates;
a housing provided with a first space that accommodates lubricating oil and accommodates a gear member that transmits rotating force to the impeller, a second space in which the ambient pressure is lower than the first space, a third space in which the impeller is provided, and a gap that brings the second space and a portion on the air intake side of the compression stage in the third space into communication;
a pressure equalizing tube that causes a gas to circulate from the first space toward the second space; and
an oil separating device that separates, in the second space, the lubricating oil contained in the gas that flows in from the first space via the pressure equalizing tube,
wherein the oil separating device comprises:
a cover member that is provided surrounding the gap and in which a suction port for the gas is formed; and
a demister that catches the lubricating oil contained in the gas that is suctioned in from the suction port,
the cover member is arranged in the second space, and
the suction port opens into the second space.

2. The turbo compressor according to claim 1, wherein the second space has a ring shape; and
the suction port is arranged in the second space on the opposite side with respect to a communicating opening of the pressure equalizing tube, sandwiching the center of the ring shape.

3. The turbo compressor according to claim 1, wherein the suction port is arranged oppositely oriented with respect to the communicating opening of the pressure equalizing tube in the second space.

4. The turbo compressor according to claim 2, wherein the suction port is arranged oppositely oriented with respect to the communicating opening of the pressure equalizing tube in the second space.

5. The turbo compressor according to claim 1, wherein the suction port is arranged facing downward in the second space.

6. The turbo compressor according to claim 2, wherein the suction port is arranged facing downward in the second space.

7. The turbo compressor according to claim 3, wherein the suction port is arranged facing downward in the second space.

8. The turbo compressor according to claim 4, wherein the suction port is arranged facing downward in the second space.

9. The turbo compressor according to claim 1, further comprising an oil returning device that returns to the first space the lubricating oil separated in the second space.

10. The turbo compressor according to claim 2, further comprising an oil returning device that returns to the first space the lubricating oil separated in the second space.

11. The turbo compressor according to claim 3, further comprising an oil returning device that returns to the first space the lubricating oil separated in the second space.

12. The turbo compressor according to claim 4, further comprising an oil returning device that returns to the first space the lubricating oil separated in the second space.

13. The turbo compressor according to claim 5, further comprising an oil returning device that returns to the first space the lubricating oil separated in the second space.

14. The turbo compressor according to claim 6, further comprising an oil returning device that returns to the first space the lubricating oil separated in the second space.

15. The turbo compressor according to claim 7, further comprising an oil returning device that returns to the first space the lubricating oil separated in the second space.

16. The turbo compressor according to claim 8, further comprising an oil returning device that returns to the first space the lubricating oil separated in the second space.

17. The turbo compressor according to claim 9, wherein the oil returning device has an ejector.

18. A turbo refrigerator comprising:
a condenser that liquefies a compressed refrigerant;
an evaporator that by evaporating the refrigerant that is liquefied by the condenser cools a cooling object; and
a turbo compressor that compresses the refrigerant that is evaporated by the evaporator and supplies it to the condenser,
wherein the turbo refrigerator is provided with the turbo compressor according to claim 1 as the turbo compressor.

19. The turbo compressor according to claim 1, wherein the demister is a packing that consists of a catching member and filled in the suction part.

20. The turbo compressor according to claim 1, wherein,
the cover member has a disc-like bottom portion and a cylindrical trunk portion which is joined along an outer edge of the bottom portion,
the trunk portion has an opening end on the opposite side of the bottom portion, and
the opening end of the trunk portion abuts the housing in the axial direction, whereby it is blocked by the housing.

* * * * *